US008636324B2

(12) United States Patent
Skea

(10) Patent No.: US 8,636,324 B2
(45) Date of Patent: Jan. 28, 2014

(54) MINING MACHINE WITH DRIVEN DISC CUTTERS

(75) Inventor: Theunis F. Skea, Irene (ZA)

(73) Assignee: Joy MM Delaware, Inc., Wilmington, DE (US)

( * ) Notice: Subject to any disclaimer, the term of this patent is extended or adjusted under 35 U.S.C. 154(b) by 389 days.

(21) Appl. No.: 12/692,149

(22) Filed: Jan. 22, 2010

(65) Prior Publication Data

US 2011/0181097 A1 Jul. 28, 2011

(51) Int. Cl.
*E21C 25/18* (2006.01)

(52) U.S. Cl.
USPC ..... 299/73

(58) Field of Classification Search
USPC ..... 299/73, 33
See application file for complete search history.

(56) References Cited

U.S. PATENT DOCUMENTS

| | | | | |
|---|---|---|---|---|
| 2,517,267 | A * | 8/1950 | Watson | 299/72 |
| 2,619,338 | A * | 11/1952 | Lindgren | 299/67 |
| 2,745,651 | A | 5/1956 | Herrmann | |
| 3,446,535 | A | 5/1969 | Lauber et al. | |
| 3,647,263 | A | 3/1972 | Lauber et al. | |
| 3,995,907 | A | 12/1976 | Dubois | |
| 4,273,383 | A | 6/1981 | Grisebach | |
| 4,838,614 | A | 6/1989 | Pentith et al. | |
| 5,938,288 | A | 8/1999 | Saint-Pierre et al. | |
| 6,561,590 | B2 | 5/2003 | Sugden | |
| 6,857,706 | B2 | 2/2005 | Hames et al. | |
| 7,695,071 | B2 | 4/2010 | Jackson et al. | |
| 7,934,776 | B2 | 5/2011 | de Andrade et al. | |
| 8,328,292 | B2 | 12/2012 | de Andrade et al. | |
| 2013/0057044 | A1 | 3/2013 | de Andrade et al. | |

FOREIGN PATENT DOCUMENTS

| | | |
|---|---|---|
| AU | 466244 | 2/1972 |
| DE | 4440261 | 5/1996 |
| SU | 619117 | 8/1978 |
| SU | 1328521 | 8/1987 |
| WO | 0043637 | 7/2000 |
| WO | 0046486 | 8/2000 |
| WO | WO 0201045 A1 * | 1/2002 |
| WO | WO 02066793 A1 * | 8/2002 |
| WO | WO 03089761 A1 * | 10/2003 |

* cited by examiner

*Primary Examiner* — Sunil Singh
(74) *Attorney, Agent, or Firm* — Michael Best & Friedrich LLP

(57) ABSTRACT

A mining machine including a cutting mechanism comprising an arm having an arm end, a disc cutter adapted to engage the material to be mined and mounted on the arm end. The disc cutter is driven by the arm into the material to be mined, and the arm further includes a main portion, and a wrist portion pivotally attached to the main portion.

19 Claims, 19 Drawing Sheets

MINING MACHINE WITH DRIVEN DISC CUTTERS

BACKGROUND OF THE INVENTION

The present invention relates to a mining machine and is particularly, although not exclusively, concerned with excavating hard rock.

Sugden U.S. Pat. No. 6,561,590 issued May 13, 2003, describes a cutting device is utilized in the herein later described invention. The Sugden device is a cutting device of a rotary (disc) undercutting type, that provides improved rock removal from a rock face and which is relatively economical to manufacture and operate.

The Sugden device employs a reaction mass of sufficient magnitude to absorb the forces applied to the rock by the disc cutter during each cycle of oscillation, with minimum or minor displacement of the device, or the structure supporting the device. Because the device usually applies a load at an angle to the rock face, it causes tensile fracture of the rock, instead of crushing the rock. This tensile fracture force applied to the rock is substantially less than that needed with crushing forces, such that a corresponding reduction in the required reaction mass compared to known rock excavation machinery can also be adopted. The Sugden device disc cutter when mounted to a support structure is preferably arranged so that the reaction mass can absorb the cyclic and peak forces experienced by the disc cutter, while the support structure provides a restoring force compared to the average force experienced by the disc cutter.

The Sugden device typically requires substantially reduced applied forces relative to known rock excavating machinery. A reduction at least in respect of normal forces, an order of magnitude or some other significant fraction, is envisaged. Such low forces facilitate the use of a support structure in the form of an arm or boom, which can force the edge of the disc cutter into contact with the rock at any required angle and to manipulate the position of the disc cutter in any direction. In particular, in relation to longwall mining, the disc cutter, or array of disc cutters, may be mounted to traverse the length of the long wall face and to be advanced in the main mining direction at each pass. Advantageously, the Sugden device provides for entry of the disc cutter into the rock face from either a previously excavated drive in a longwall excavation, or from pre-bored access holes, or by attacking the rock at a shallow angle to the face until the required depth for the pass is achieved. With the disc cutter mounted on a movable boom, the disc cutter can be moved about the rock face to excavate that face at any desired geometry.

One difficulty when using such a disc cutter mounted on the end of a pivot arm, is to support the weight of the disc cutter head, while at the same time permitting the pivot arm to swing through more than 180°.

SUMMARY OF THE INVENTION

It is an object of the disclosure to provide a mining machine that can effectively use an eccentrically driven disc to mine materials.

It is a further object of the disclosure to provide a mining machine that can cut into a mine face by swinging an arm throught an arc of more than 180°.

This disclosure provides a mining machine including a cutting mechanism comprising an arm having an arm end, a disc cutter adapted to engage the material to be mined and mounted on the arm end. The disc cutter is driven by the arm into the material to be mined, and the arm further includes a main portion, and a wrist portion pivotally attached to the main portion.

BRIEF DESCRIPTION OF THE DRAWINGS

FIGS. 11 through 17 illustrate the motion sequence of the arm movement.

Figure 1:
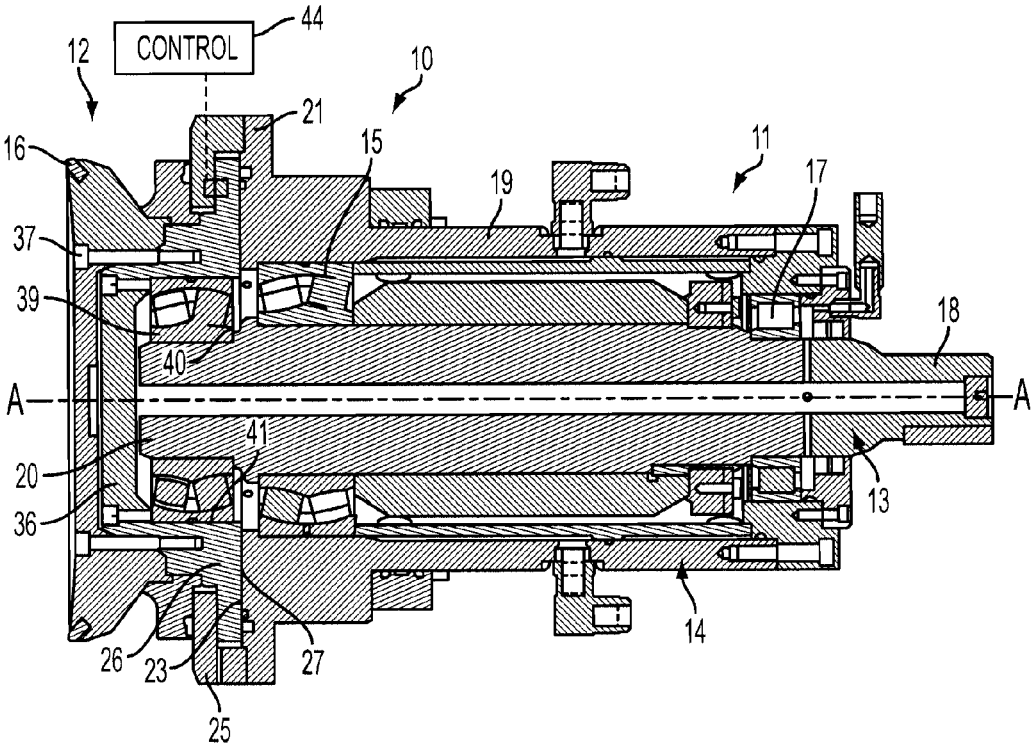
FIG. 1 is a cross-sectional view of a disc cutter assembly.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Further, it is to be understood that such terms as "forward", "rearward", "left", "right", "upward" and "downward", etc., are words of convenience in reference to the drawings and are not to be construed as limiting terms.

DETAILED DESCRIPTION OF THE PREFERRED EMBODIMENTS

FIG. 1 is a cross-sectional view of a disc cutter assembly. The disc cutter assembly 10 includes a mounting assembly 11 and a rotary disc cutter 12. The mounting assembly 11 includes a mounting shaft 13 which is rotatably mounted within a housing 14, that can constitute or be connected to a large mass for impact absorption. The housing 14 thus, can be formed of heavy metal or can be connected to a heavy metallic mass. The mounting shaft includes a shaft drive section 18 and a disc drive section 20.

A rock excavating or mining machine according to the present invention includes the disc cutter 12, and is characterized in that the disc cutter is driven to move in an eccentric manner. The magnitude of eccentric movement is directly proportional to the amount of offset between the disc drive section axis and the center of the shaft drive section axis and generally that amount is relatively small. Preferably, the disc cutter 12 is caused to be driven eccentrically through a relatively small amplitude and at a high frequency, such as about 3000 RPM.

The motion by which the disc cutter 12 is driven, is such as to usually attack the rock at an angle and cause tensile failure of the rock, so that chips of rock are displaced from the rock surface under attack by the disc cutter. Here, the invention differs from rolling edge disc cutters, which apply force normal to the rock face to form lateral cracks that produce rock chips. The force required to produce a tensile failure in the rock to displace a rock chip according to the disc cutter assembly is an order of magnitude less than that required by the known rolling edge disc cutters to remove the same amount of rock, so that the device of the invention is far more efficient in respect of energy requirements.

The disc cutter 12 of the disc cutter assembly 10 preferably has a circular periphery. The disc cutter 12 includes a plurality of spaced apart cutting tips or bits 16, preferably of tungsten carbide, which are fixed to the circular periphery thereof. The periphery of the disc cutter 12 is arranged to be free to rotate relative to the oscillating movement thereof, so that the periphery can roll against the rock surface under attack. In this manner, all parts of the cutting periphery edge are progressively moved out of contact with the rock and allowed to cool, and wear is evenly distributed. Because the contact force is relatively low, the wear rate is reduced compared to the rolling edge type of cutter.

More particularly, the oscillating or eccentric movement of the disc cutter 12 can be generated in any suitable manner. In the preferred arrangement, the disc cutter 12 is mounted for rotary movement on the shaft drive section 18 driven by suitable driving means (not shown) and the disc drive section 20, as hereafter described, on which the disc cutter 12 is mounted. The axis about which the shaft drive section 18 rotates is offset from the disc drive section 20 so that the disc cutter 12 is forced to move in an eccentric manner. As shown in FIG. 1, the cross section of the disc drive section 20 shows the disc drive section 20 to be thicker below the shaft drive section 18 central axis. The central axis of the disc cutter 12 and its disc drive section 20 is offset from the axis of the shaft drive section 18 in the order of a few millimeters only. The magnitude of the offset determines the extent of the oscillating (eccentric) movement of the disc cutter 12. This eccentric movement of the disc cutter causes a jackhammer like action of the disc cutter 12 against the mineral to be mined.

In alternate constructions (not shown), the disc cutter 12 could also be caused to nutate simultaneously as it oscillates, by making the axis about which the driven section rotates angularly offset from the axis of the mounting section of the disc cutter 12, as described in Sugden U.S. Pat. No. 6,561,590.

The disc cutter 12 is mounted on the cutter assembly 10 by means of a mounting rotor 36. The mounting assembly 11 includes the housing 14 having a shaft supporting section 19. The housing 14 also supports the mounting rotor 36. The shaft supporting section 19 has a longitudinal axis that coincides with the drive shaft 13 axis. The drive shaft 13 is rotatable mounted within the shaft supporting section 19 by bearings 15 and 17, which can be of any suitable type and capacity. The bearings 15 and 17 are mounted in any suitable manner known to a person skilled in the art.

One end 21 of the shaft supporting section 19 has a flat radially extending surface 23. Attached to the outer periphery of the flat radially extending surface 23 is an annular disc retaining cap 25. The disc mounting rotor 36 includes one end 26 and it also has a flat radially extending surface 27. The one end 26 of the disc mounting rotor 36 is adjacent the one end 21 of the shaft supporting section 19, and the two ends 21 and 26 bear against one another in order to support the disc mounting rotor 36 and the cutter disc 12 for rotational movement of the cutter disc 12 relative to the shaft supporting section 19. The one end 21 of the disc mounting rotor 36 is held in place by the disc retaining cap 25, which extends over a section of the outer periphery of the disc mounting head end 21. Sufficient clearance is provided between the one end 21 of the disc mounting rotor 36 and the disc retaining cap 25 to permit the eccentric movement of the disc mounting rotor 36 and cutter disc 12 relative to the disc retaining cap 25. Lubrication ports (not shown) keep an oil film between the respective flat radially extending surfaces 23 and 27, as well as feed lubricants to the other moving parts within the cutter assembly 10. The disc cutter 12 is mounted on the mounting rotor 36 by suitable connecting means, such as threaded connectors 37. The cutting disc 12 can be removed from the disc cutter assembly 10 for replacement or reconditioning, by removing the connectors 37.

The disc cutter 12 is mounted for free rotational movement on the disc drive section 20. The disc cutter 12 is mounted by a spherical roller bearing 39 that is located by a step 40 and a wall 41 of the mounting rotor 36. The large bearing 39 is aligned directly in the load path of the disc cutter 12 and thus is subject to the majority of the radial cutter load. The various bearings employed in the cutter assembly 10 can be of any suitable kind, but preferably they are anti-friction roller bearings, and can be hydrodynamic or hydrostatic bearings.

Figure 2:
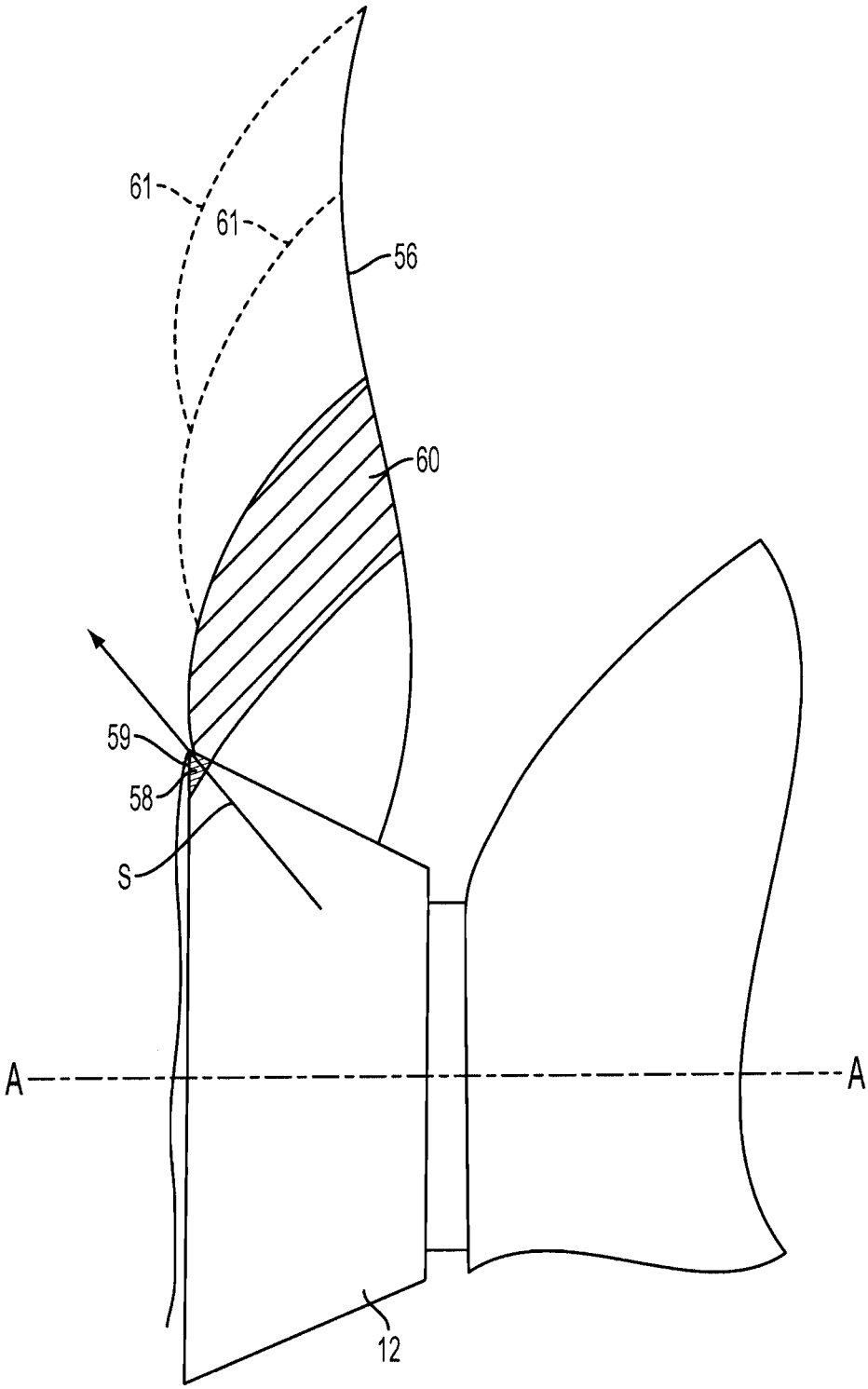
FIG. 2 is a schematic view of the action of the disc cutter assembly in excavating a rock face.

The movement of the disc cutter 12 applies an impact load to the rock surface under attack that causes tensile failure of the rock. With reference to FIG. 2, it can be seen that the motion of the disc cutter 12 brings the cutting tip or edge 58 into engagement under the oscillating movement at point 59 of the rock 56. Such oscillating movement results in travel of the disc cutter 12 in a direction substantially perpendicular to the axis AA of the mounting shaft 13. The provision of oscillating movement causes the cutting edge 58 to strike the face 59 substantially in the direction S, so that a rock chip 60 is formed in the rock as shown. Future chips are defined by the dotted lines 61. The action of the disc cutter 12 against the under face 59 is similar to that of a chisel in developing tensile stresses in a brittle material, such as rock, which is caused effectively to fail in tension. The direction S of impact of the disc cutter against the rock under face 59 is reacted through the bearing 39.

Figure 3:
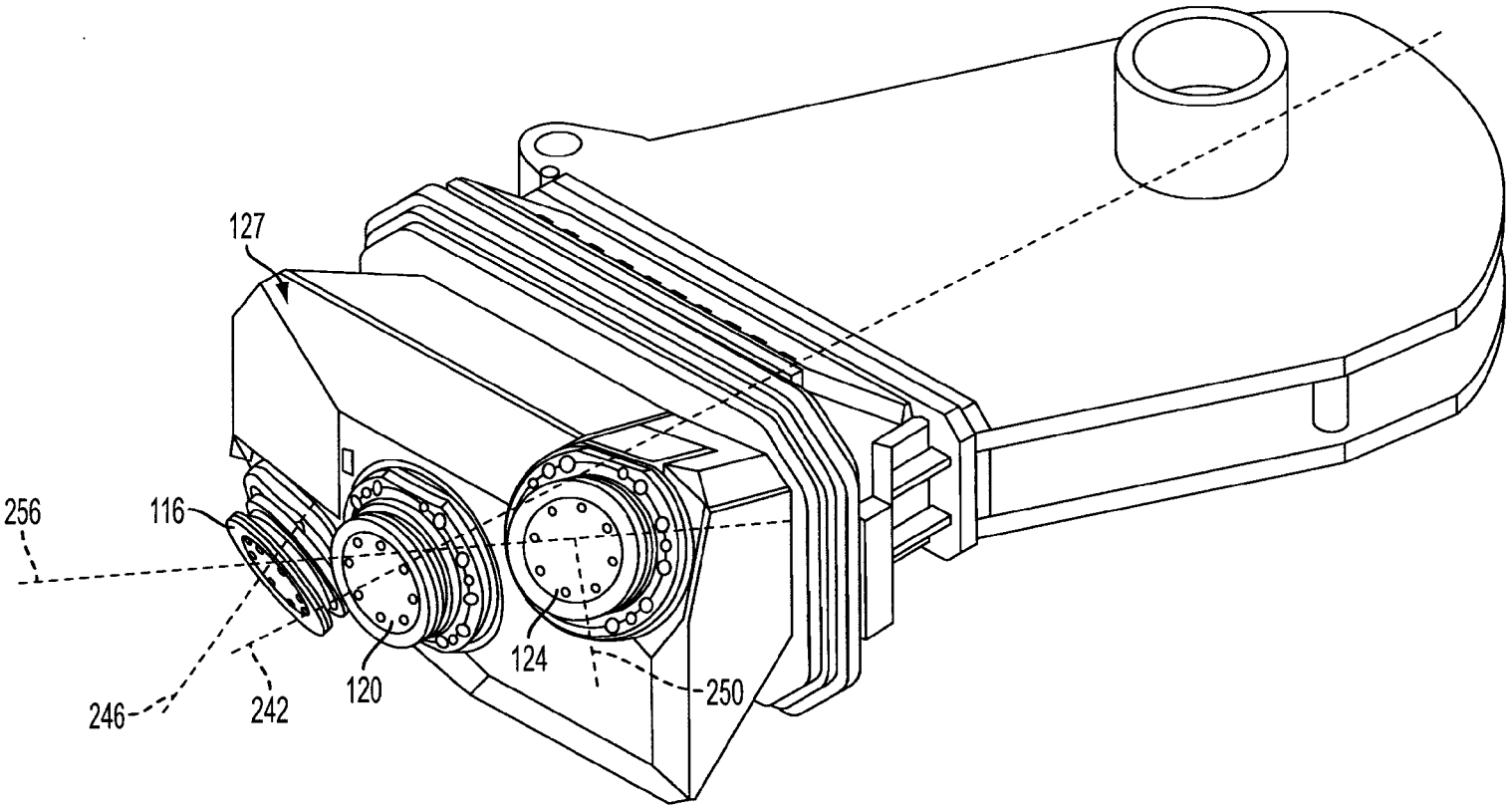
FIG. 3 is a perspective view of the cutting mechanism of this invention.
Figure 4:
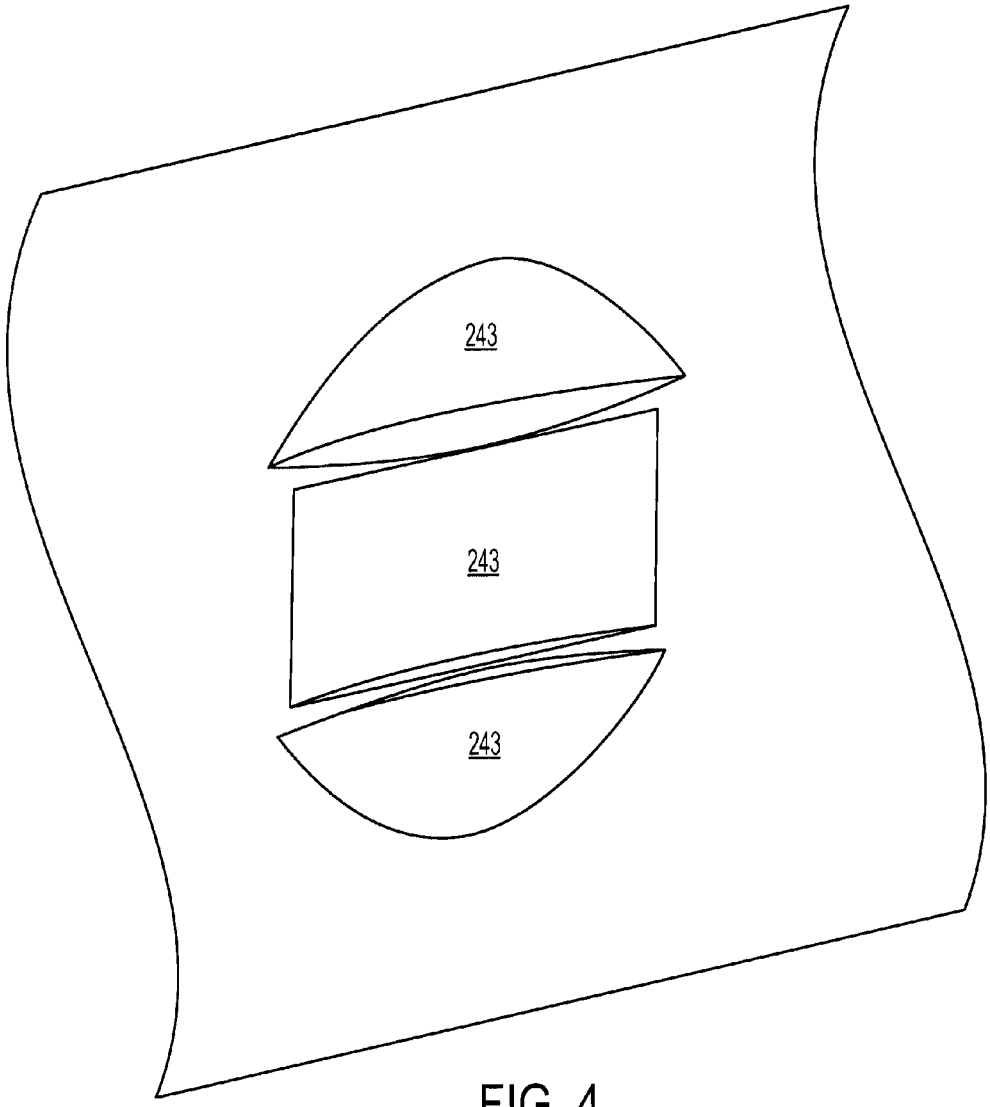
FIG. 4 is a perspective schematic view of the cutting pattern of the plurality of disc cutter assemblies in accordance with the invention.
Figure 5:
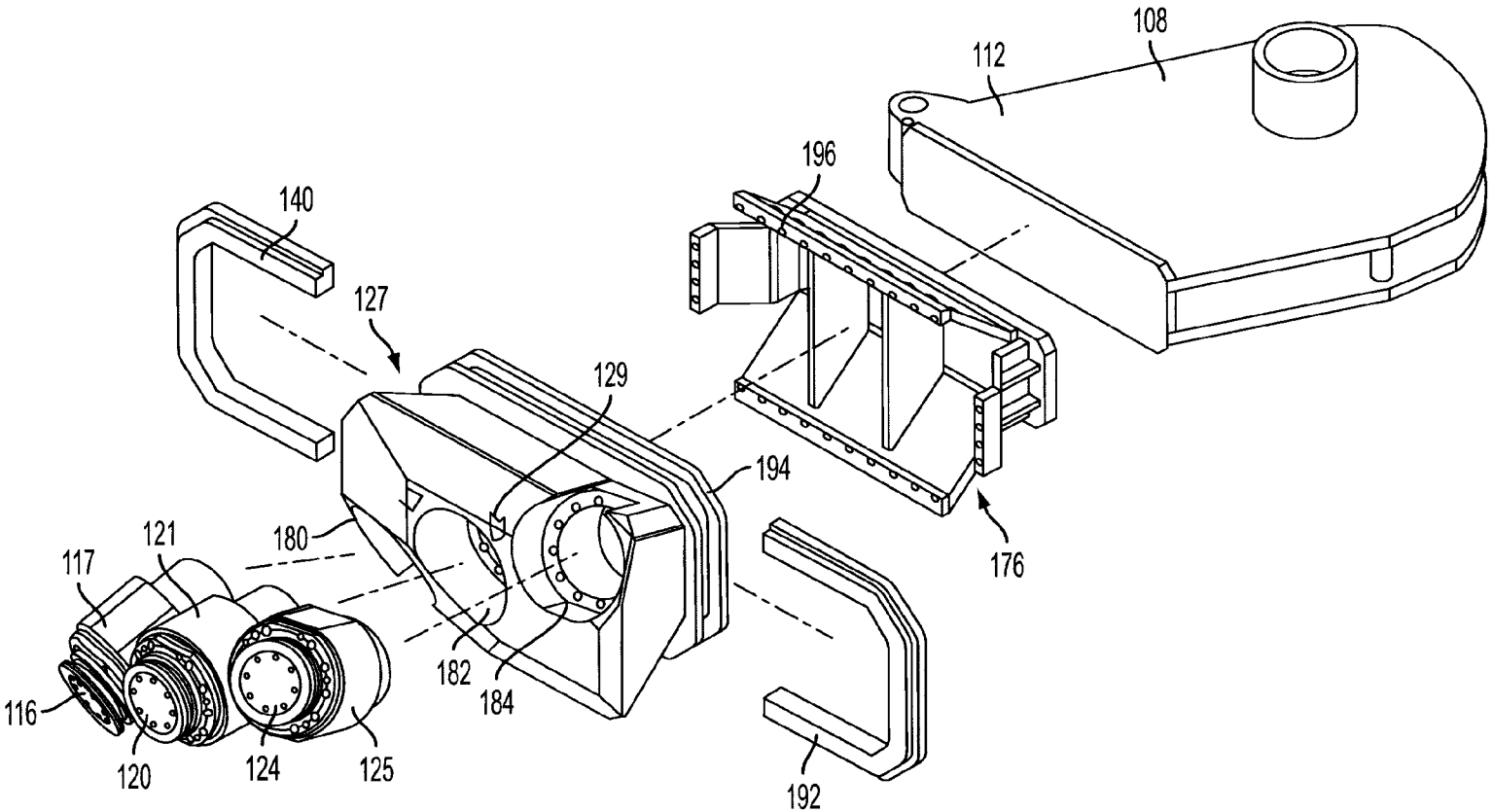
FIG. 5 is a perspective exploded view of the cutting mechanism of FIG. 3.
Figure 8:
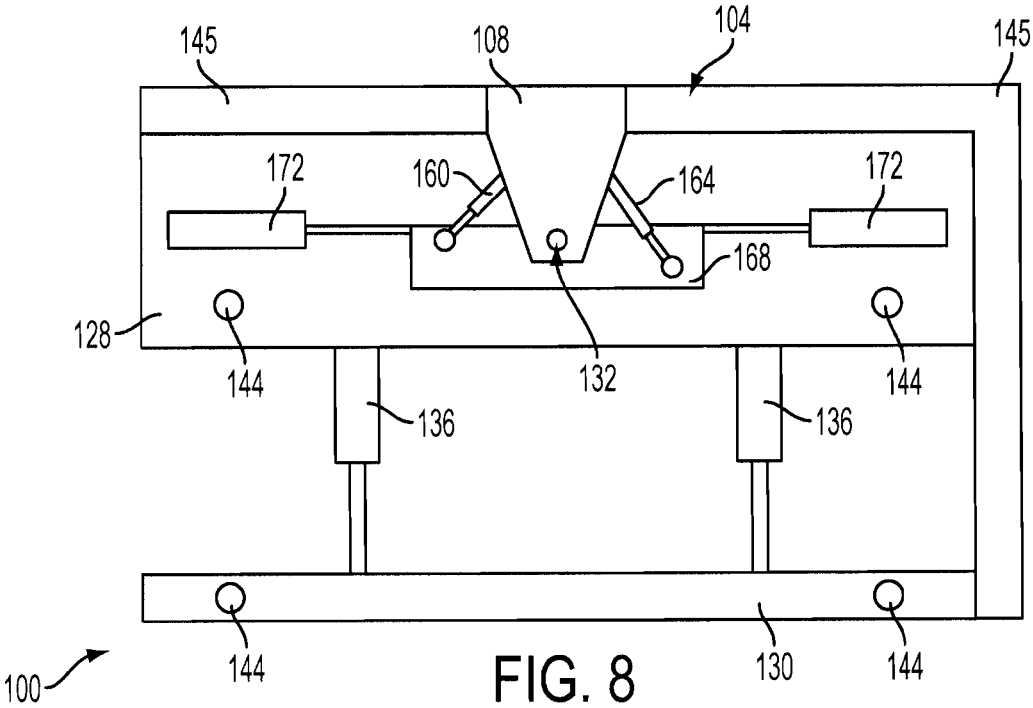
FIG. 8 is a schematic top view of the mining machine of this invention.

FIGS. 3, 5 and 8 illustrate a mining machine 100 (see FIG. 8) in accordance with the invention. The mining machine 100 includes a cutting mechanism 104 comprising an arm 108 having an arm end 112 (see FIG. 5), a first disc cutter 116 mounted on the arm end 112 via a large absorption mass 127 (see FIG. 5) and adapted to engage the material to be mined. The cutting mechanism 104 further includes a second disc cutter 120 mounted on the arm end 112 and spaced apart from the first disc cutter 116 and adapted to engage the material to be mined, and a third disc cutter 124 mounted on the arm end 112 and spaced apart from the first disc cutter 116 and the second disc cutter 120 and adapted to engage the material to be mined. More particularly, each of the disc cutters 116, 120 and 124, respectively, is part of a disc cutter assembly 117, 121 and 125 (see FIG. 5) as described above.

The disc cutters 116, 120 and 124 are mounted for movement into the rock being excavated. Thus, the mining machine 100 is mounted for example, on wheels or rails or crawlers or tracks (all not shown) and it is preferred that the mounting facility be arranged to react to the approximate average forces applied by the disc cutter, while the large absorption mass 127 (see FIG. 5) reacts the peak forces, as described below.

More particularly, as shown in FIG. 8, the cutting mechanism 104 further includes means to bring the disc cutter into the material to be mined, the means including a forward platform 128 and a rearward platform 130, pivot means 132 for mounting the arm for swinging horizontal side to side movement on the forward platform 128, and extendable and retractable means between the forward platform and the rearward platform in the form of a pair of spaced apart hydraulic cylinders 136 for moving the forward platform 128 forward (toward the material to be mined) relative to the rearward platform 130, when the rearward platform 130 is anchored, and the rearward platform 130 forward relative to the forward platform 128 when the forward platform 128 is anchored. A conveyor 145 or a vacuum system (not shown) or both can be positioned under the disc cutters and on one side of the machine 100, as shown schematically in FIG. 8, to remove dislodged material.

Each of the disc cutters 116, 120 and 124 is driven by the arm 108 into the material to be mined by swinging the arm 108 into the material to be mined by first and second hydraulic cylinders 160 and 164, respectively, connected between the arm 108 and the forward platform 128. In other embodiments (not shown), a hydraulic or electric rotary actuator can be used to rotate the arm 108, increasing the amount of arm rotation. The arm 108 is also translatable relative to the forward platform 128 by mounting the arm 108, its means for pivoting 132, and the cylinders 160 and 164 on an arm platform 168 slidable along a rail (not shown) on the forward platform 128 parallel to the material to be mined. Cylinders 172 connected between the arm platform 168 and the forward platform 128 move the arm 108 along the face (sideways) relative to the forward platform 128.

The mass of each of the disc cutters is relatively much smaller than the mass 127 provided for load absorption purposes. The load exerted on each disc cutter when it engages a rock surface under the oscillating movement is reacted or absorbed by the inertia of the large mass 127, rather than by the arm 108 or other support structure.

Figure 6:
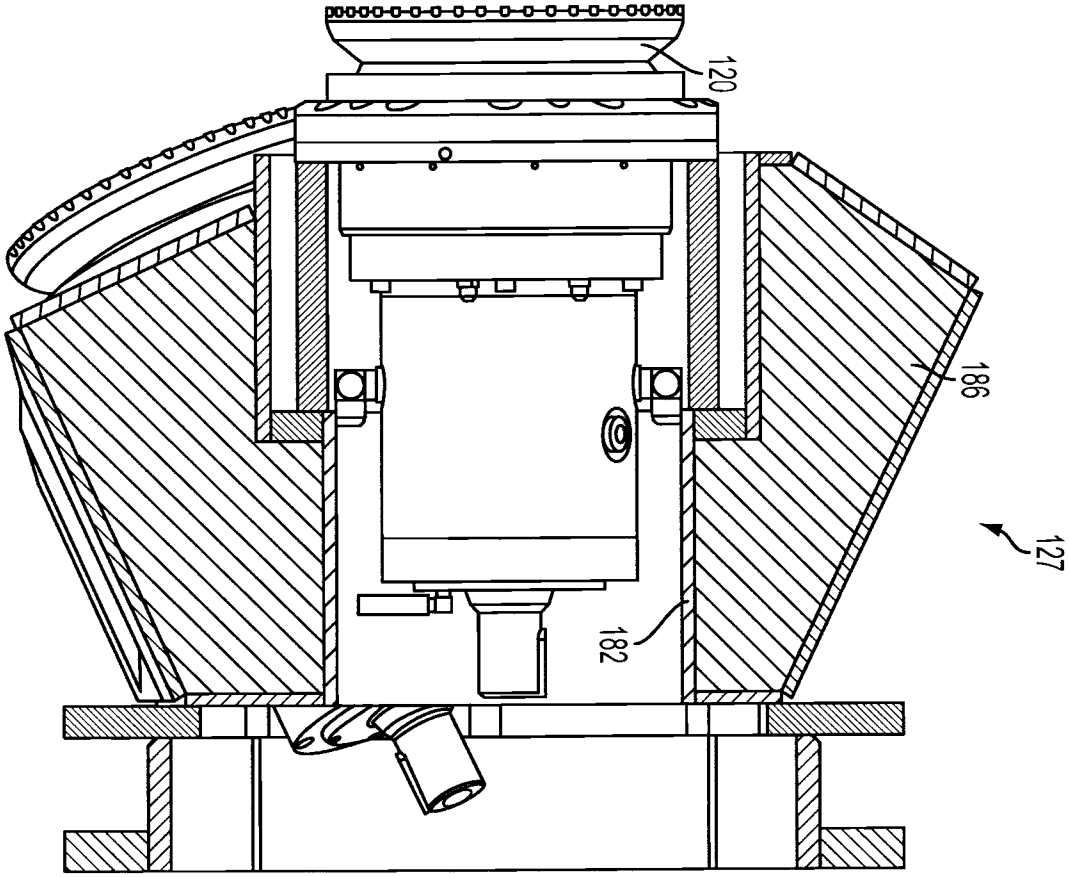
FIG. 6 is a partial cross sectional view of a cutting head section of the cutting mechanism of FIG. 3.

More particularly, as illustrated in FIGS. 3 and 5, the cutting mechanism 104 includes the arm 108, the large mass in the form of a cutter head 127, and a bracket 176 for attaching the cutter head 127 to the arm 108. The cutter head 127 is the housing that receives the 3 disc cutter assemblies 10. Still more particularly, the cutter head includes three openings 180, 182 and 184, respectively, each of which releasably receives, in a conventional manner, one of the disc cutters 116, 120 and 124, and their respective assemblies. The cutter head interior volume surrounding the three openings is filled with a heavy material, such as poured in or precast lead 186, as shown in the cross section the cutter head 127 in FIG. 6. Water jets 129 (see FIGS. 3 and 5) are mounted adjacent the front and rear of each disc cutter in the mineral cutting direction to aid in the clearing of material away from the disc cutter. By having the three eccentrically driven disc cutters share a common heavy weight, less overall weight is necessary thus making the mining machine 100 lighter and more compact. In the preferred embodiment, about 6 tons is shared among the three disc cutters, and each disc cutter is about 35 centimeters in diameter. In other embodiments, smaller or larger disc cutters can be used.

Figure 7:
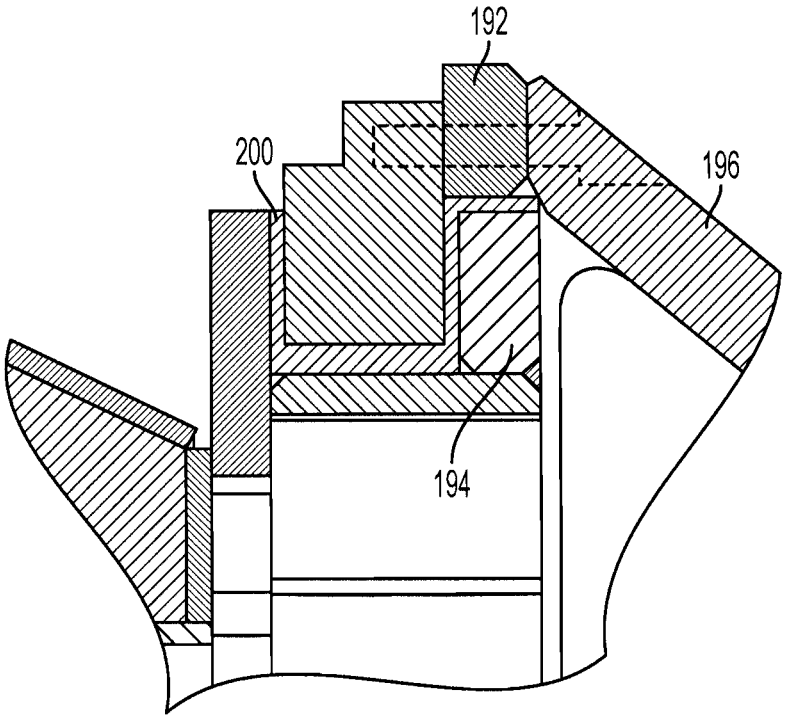
FIG. 7 is an enlarged cross-sectional view of a section of the mounting of a cutter head on an arm attachment bracket.

The bracket 176 is secured to the arm 108 in a suitable fashion (not shown), such as by welding. The bracket 176 is attached to the cutter head 127 by two U-shaped channels 190 and 192. Each channel receives a flange 194 on the cutter head 127 and a flange 196 on the bracket 176 in order to attach the cutter head 127 to the bracket 176. As illustrated in FIG. 7, a resilient sleeve 200 is placed between the cutter head 127 and the bracket 176 to isolate cutter head vibrations from the arm 108.

Figure 9:
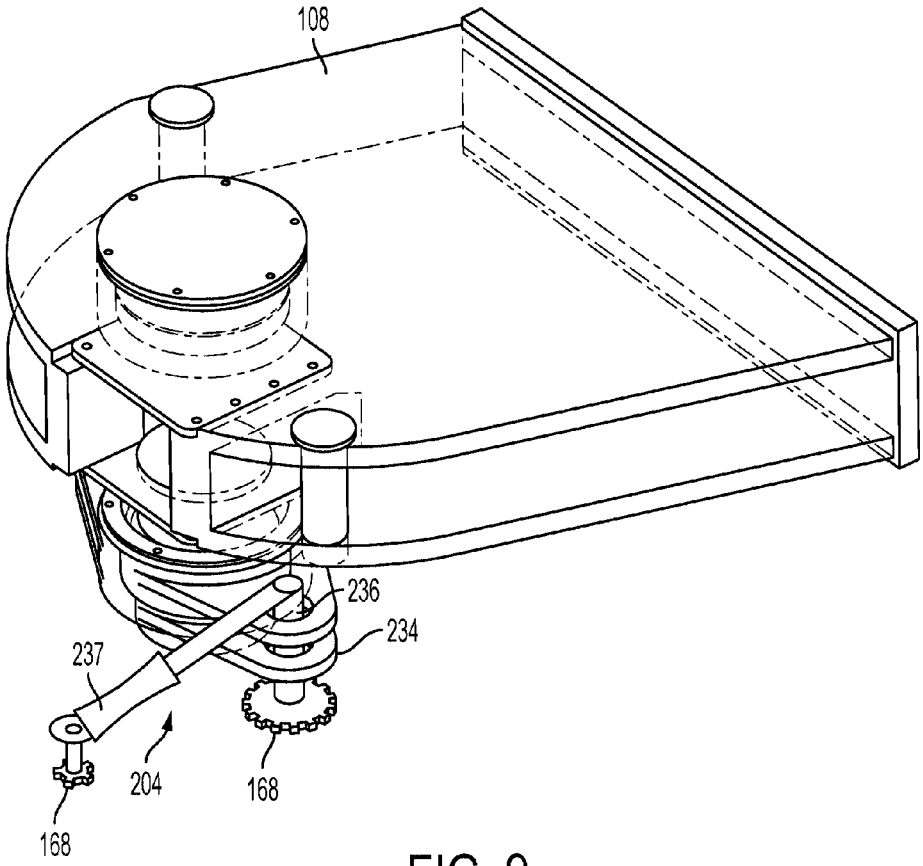
FIG. 9 is a perspective view of a mechanism for pivotally mounting an arm on the forward platform of the mining machine shown in FIG. 8.
Figure 10:
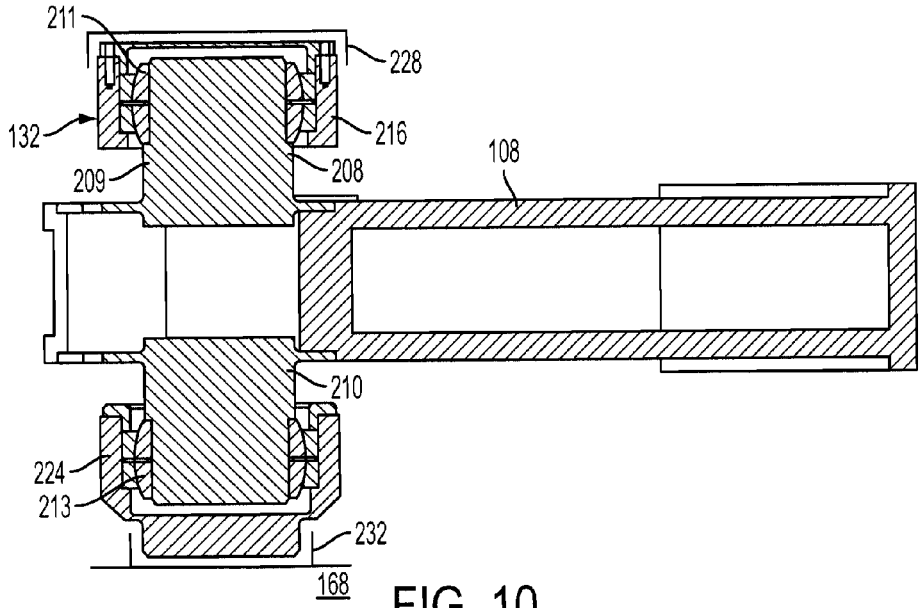
FIG. 10 is a cross-sectional view through the pivot mechanism and arm of FIG. 9.
Figure 11:
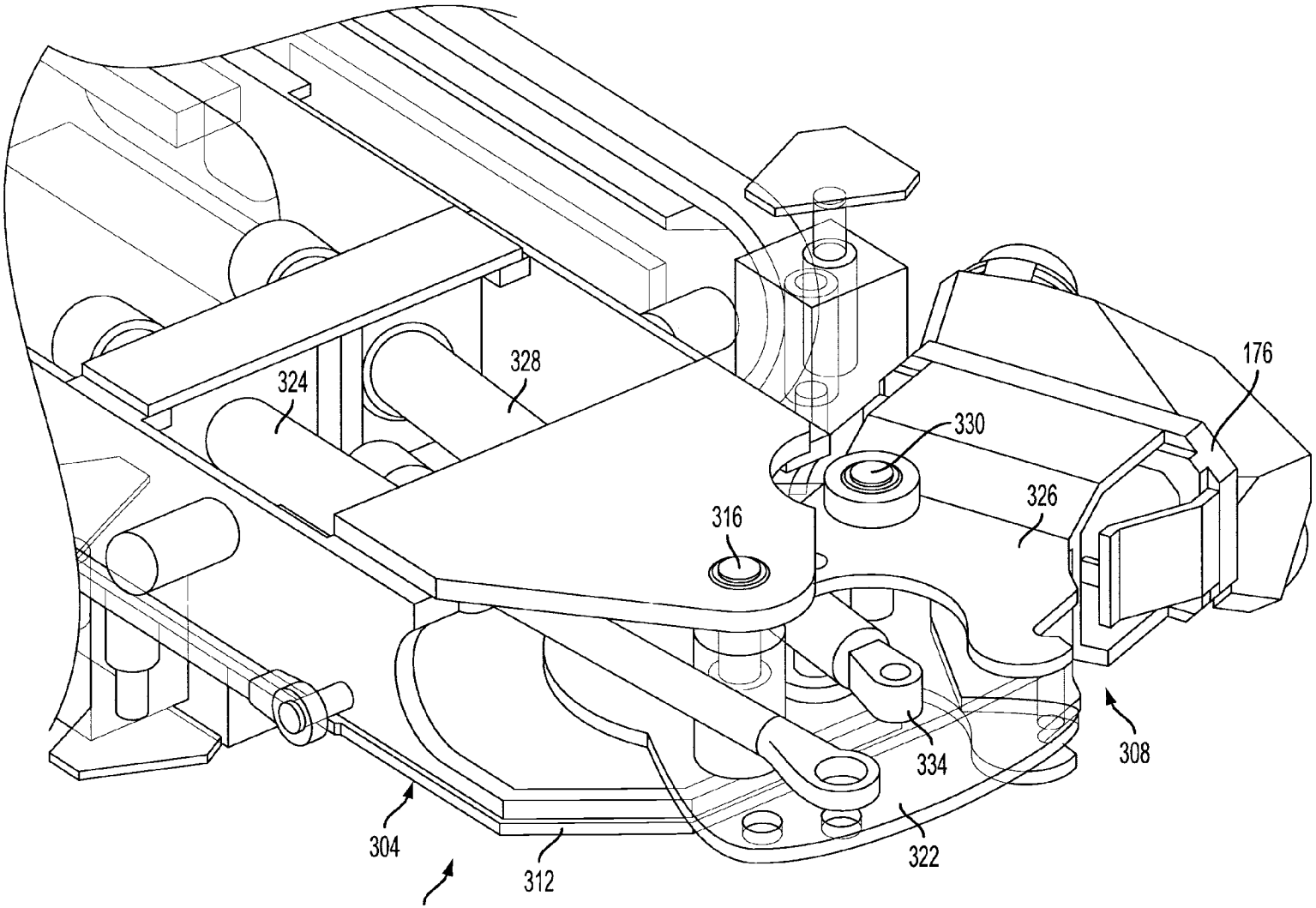
FIGS. 11 through 17 are perspective views of the cutting mechanism arm, as shown in FIG. 5.
Figure 12:
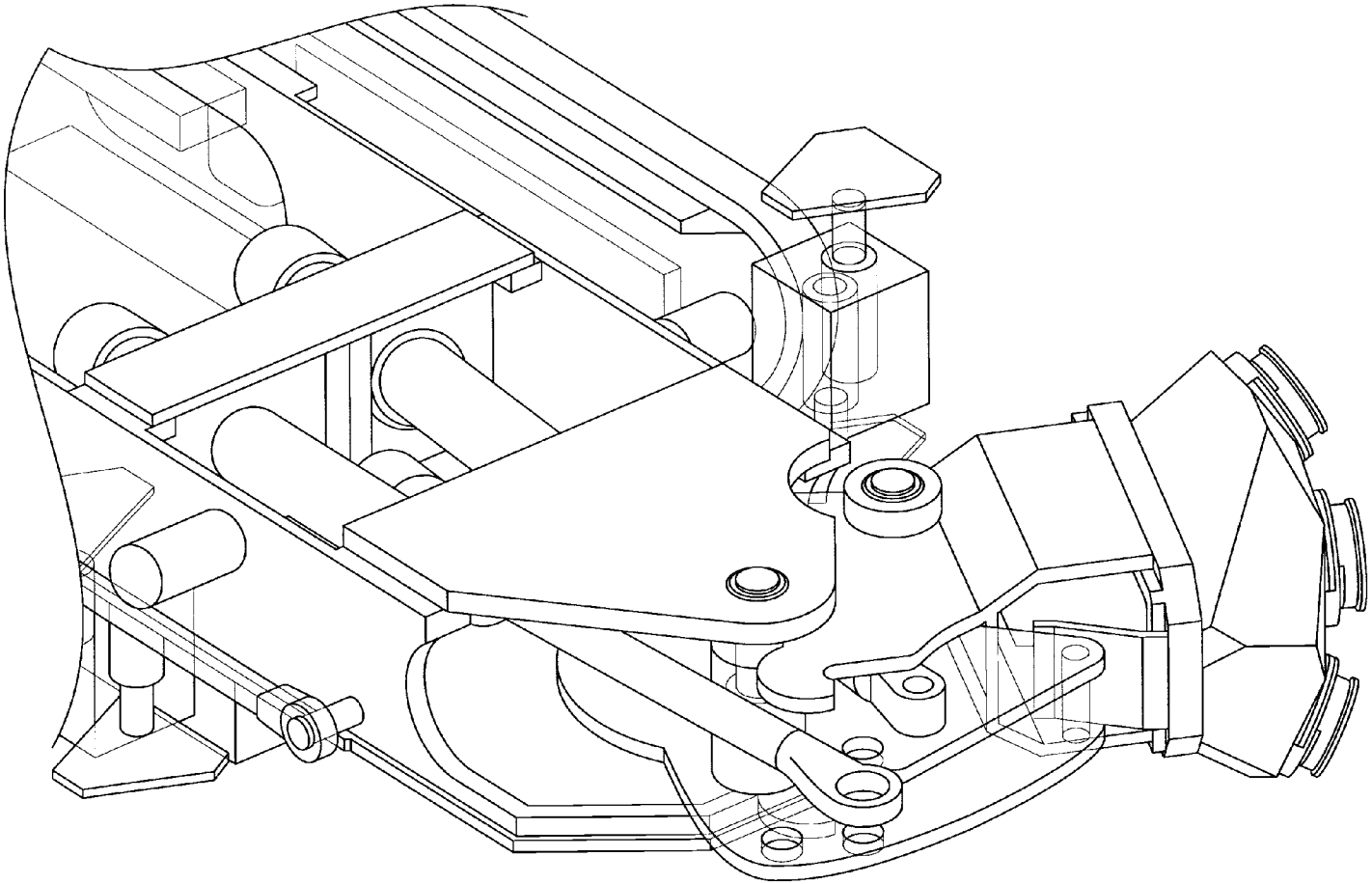
Figure 13:
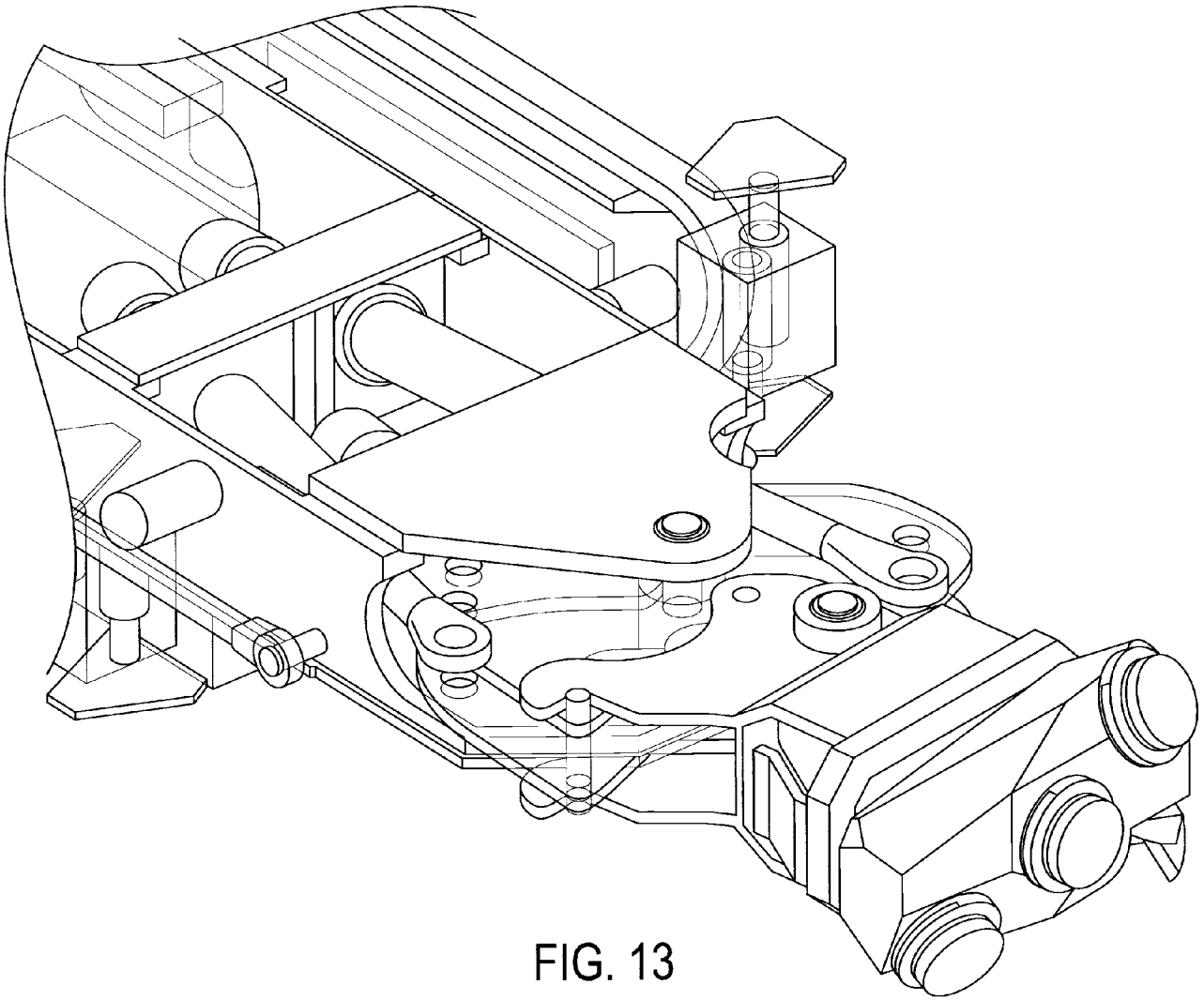
Figure 14:
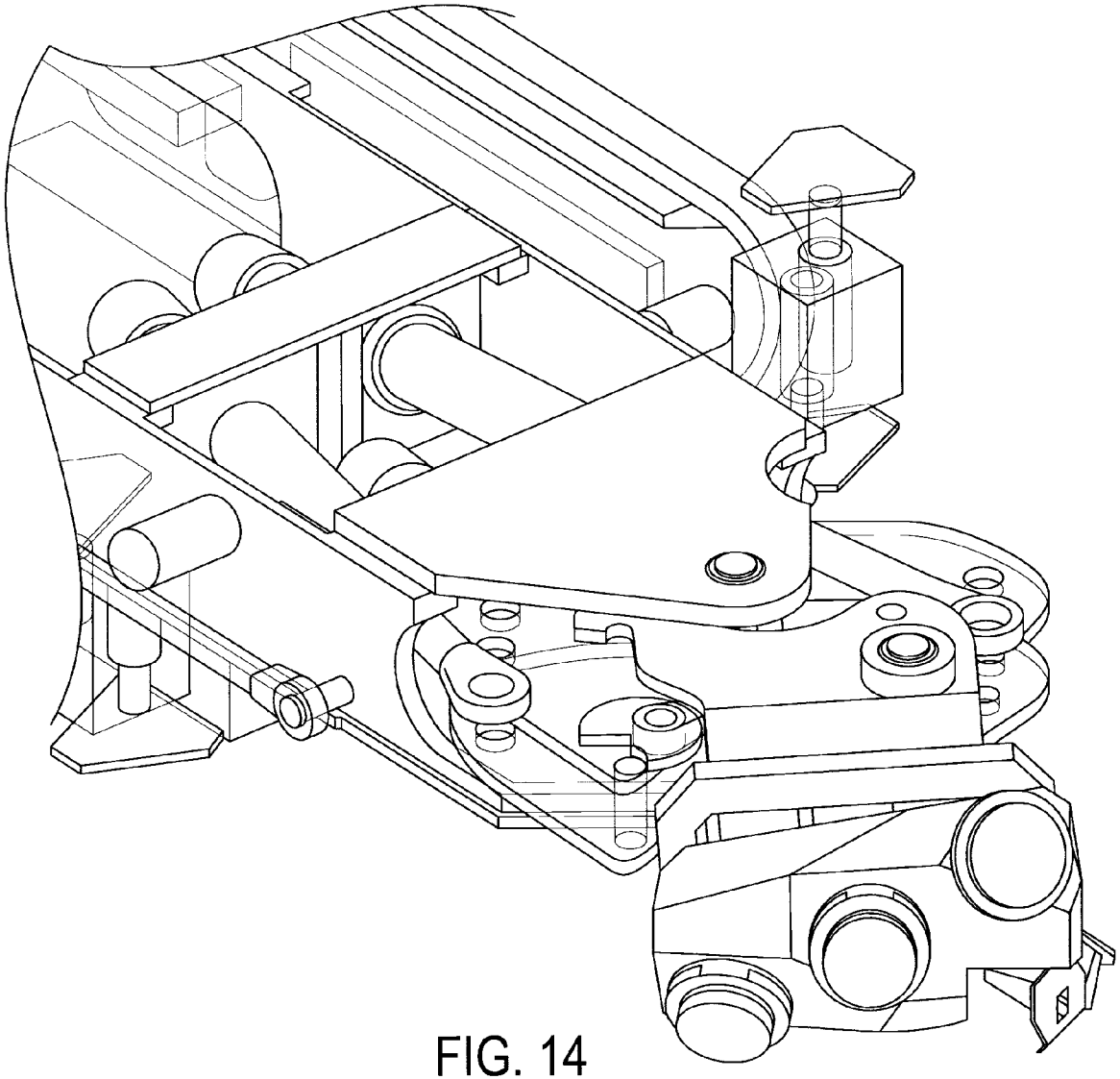

As illustrated in FIGS. 9 and 10, the means 132 for pivot mounting of the arm 108 for swinging horizontal side to side movement on the forward platform 128 includes pivot 204 for vertical top to bottom movement of the arm 108. The pivot means 132 includes a split support pin 208 having a top pin 209 attached to the top of the arm 108 and a bottom pin 210 attached to the bottom of the arm 108. More particularly, the pivot means 204 includes an upper spherical bearing housing 216 and a lower spherical bearing housing 224. The arm 108 is mounted on the top pin 209 by an upper spherical bearing 211 between the upper spherical bearing housing 216 and the top pin 209, and the arm 108 is mounted on the bottom pin 210 by a lower spherical bearing 213 between the lower spherical bearing housing and the bottom pin 210. Each of the spherical bearing housings 216 and 224 are held stationary relative to the arm platform 168 by receptacles 228 and 232, as shown schematically in FIG. 10.

In order to accomplish the vertical up and down or top to bottom movement of the arm 108, the means 204 includes a lever 234 attached to the lower spherical bearing housing 224, a pin 236 attached to the lever 234 and pivotally attached at its base to the arm platform 168, and means for pivoting the lever in the form of a hydraulic cylinder 237 connected between the top of the pin 236 and the arm platform in order to pivot the lower spherical bearing housing 224 and thus pivot the arm 108. An identical lever and pin attached to the base platform 168 (all not shown) are attached to the opposite side of the lower spherical bearing housing 224, thereby providing a fixed pivot point for the assembly.

The mining machine 100 is operated by advancing using the hydraulic cylinders 136 the arm 108 toward the material to be mined a first incremental distance, swinging the arm 108 to cut the material, and then advancing the arm 108 toward the material to be mined a second incremental distance, the second incremental distance being the first incremental distance. As a result, contact between the cutter head 127 and the mineral to be mined is minimized. During the return of the arm 108 to its beginning to cut position, the arm 108 is backed up slightly (about 4 cm) to help prevent the cutter head 127 contacting the face during its return.

FIGS. 11 through 20 illustrate another embodiment of a mining machine arm 300. Where in the first embodiment, the arm 108 could swing through an arc of about 120° to 150°, in this embodiment, the arm 300 can swing through an arc of about 220°.

The arm 300 shown is similar in many respects to the arm 108 of the first embodiment, as shown in FIG. 5, except for now the pivot arm 300 includes a main portion 304, and a wrist portion 308 pivotally attached to the main portion 304. More particularly, the main portion 304 includes two spaced apart horizontal main plates 312. Rotatably mounted and extending between the two main plates 312 is a support 316. The wrist portion 308 is attached to the support 316, and can pivot relative to the main portion 304 by rotating about the support 316.

The wrist portion 308 includes two spaced apart mounting plates 322 attached to the support 316, and two spaced apart wrist plates 326, parallel to but spaced radially outward from the mounting plates 322. The wrist plates 326 are pivotally attached to the mounting plates 322 by a support rod 330 that extends between the wrist plates 326 and through an opening (not shown) in the mounting plates 322. Attached to the wrist plates 326 is the cutter head mounting bracket 176.

In order to rotate the mounting plates 322 relative to the main portion 304, two spaced apart hydraulic cylinders 324 and 328 extend between the main portion 304 and the wrist portion 308. One cylinder 324 is attached to the mounting plate 322 on one side of the support 316, and the other cylinder 328 is attached to the same mounting plate 322 on the other side of the support 316. By extending one cylinder and retracting the other cylinder, the wrist portion 308 can pivot relative to the main portion 304 about the support 316.

In order to pivot the wrist plates 326 relative to the mounting plates 322, a wrist hydraulic cylinder 334 is mounted on the lowermost mounting plate 322, and extends between the mounting plate 322 and a wrist rod 340 (see FIG. 19) attached to and extending between the spaced apart wrist plates 326, and received in and passing through a curved slot 344 in the mounting plates 322.

In order to pivot the wrist plates 326 relative to the mounting plates 322, the wrist hydraulic cylinder 334 is extended or retracted.

In order to pivot the cutting mechanism 104 through more than 180°, a sequence of pivoting motions is illustrated in FIGS. 11 through 20. More particularly, in FIG. 11, the leftmost main hydraulic cylinder 328 is shown retracted, and the rightmost main hydraulic cylinder 324 is shown extended. This results in the cutting mechanism 104 being at about eight o'clock position when looking down at the top of the arm. In this position, the wrist cylinder 334 is retracted.

In other embodiments (not shown), other means for pivoting the mounting plates or the wrist plates, other than hydraulic cylinders, can be used. For example, a mechanical screw, a rack and pinion, or an electric motor and gear assembly, could be used.

Figure 15:
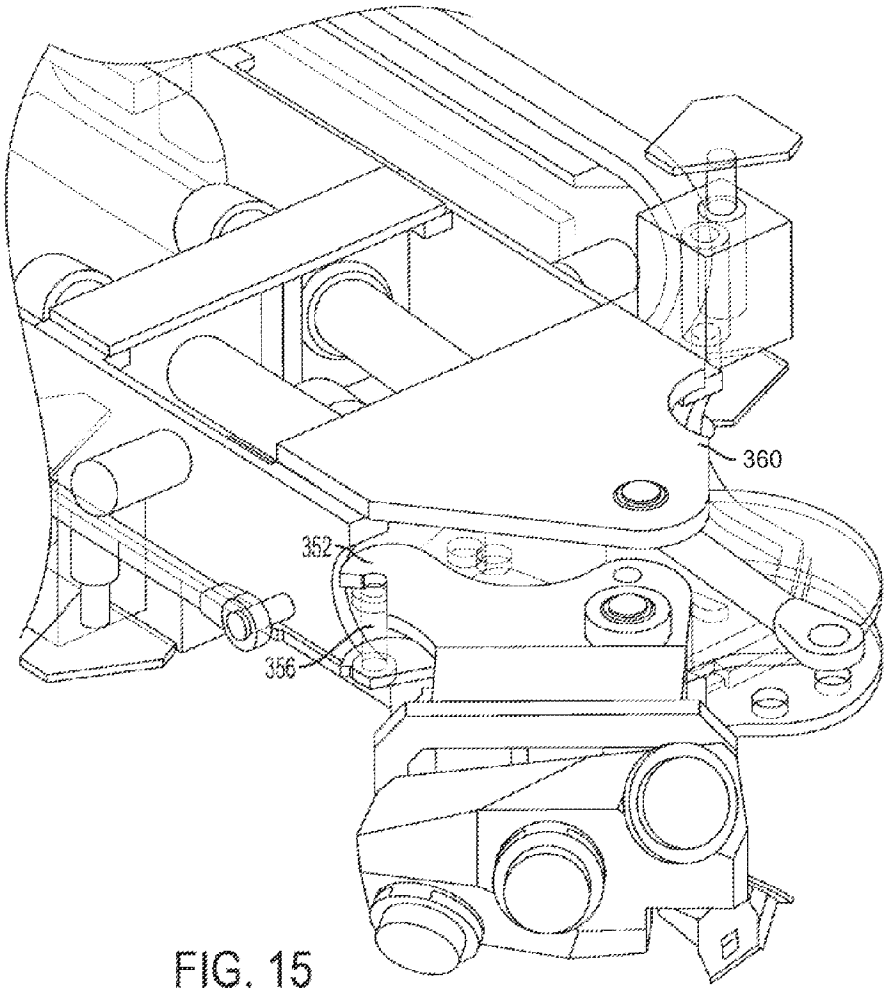
Figure 16:
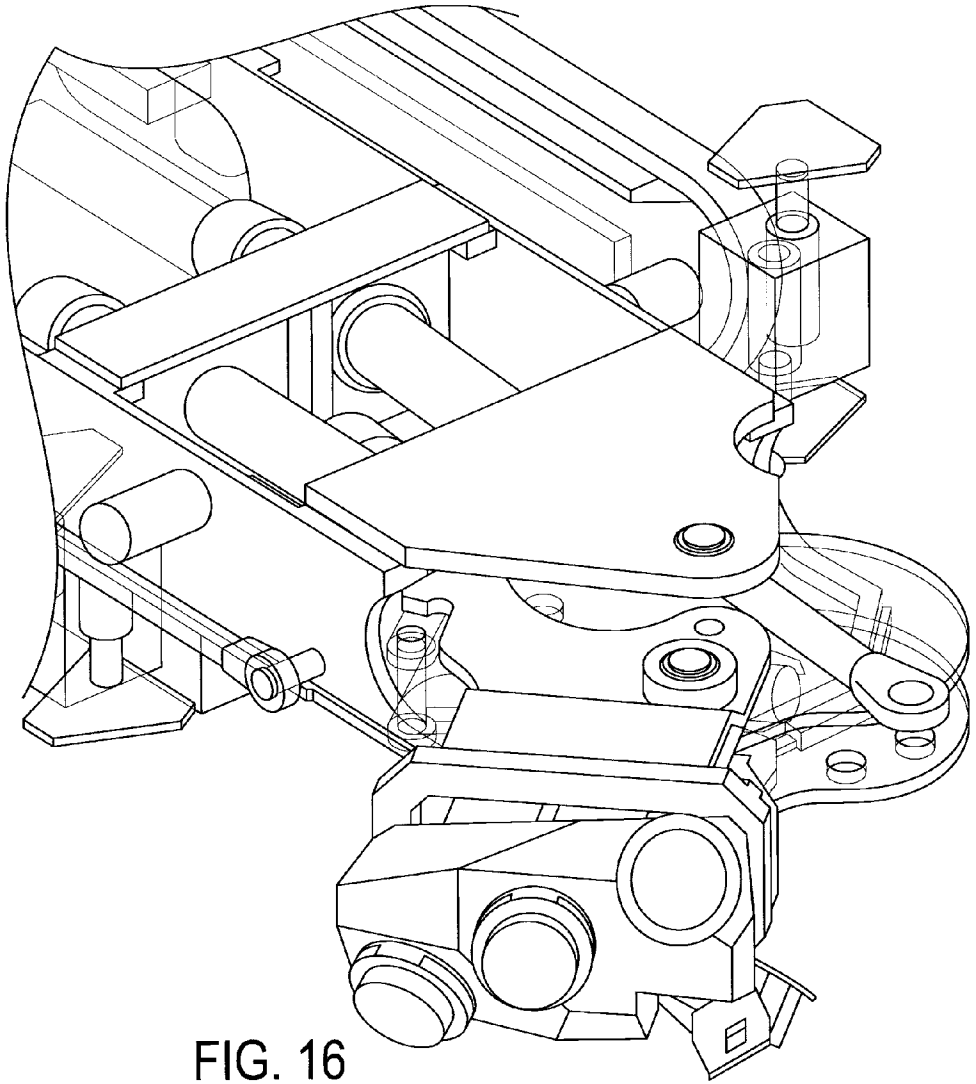
Figure 17:
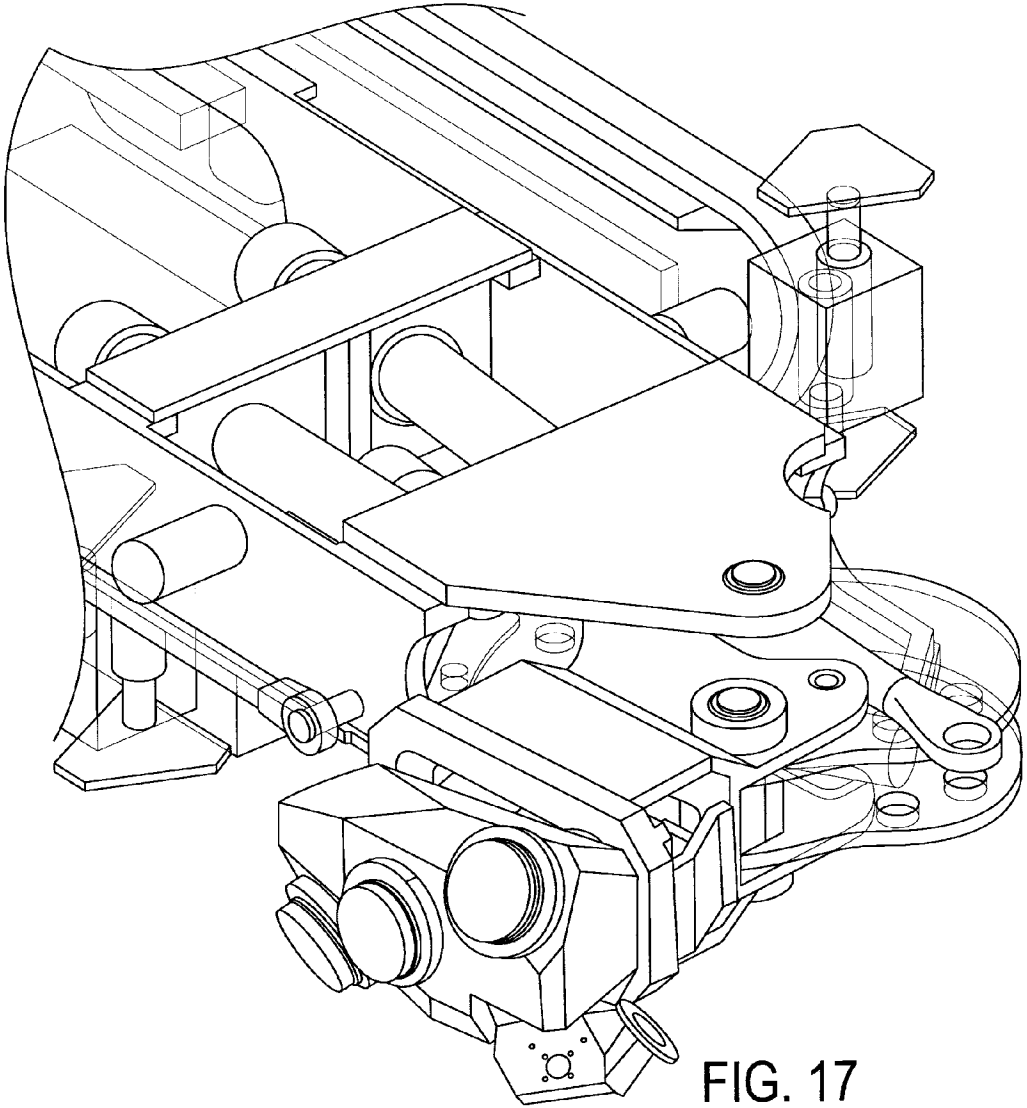
Figure 18:
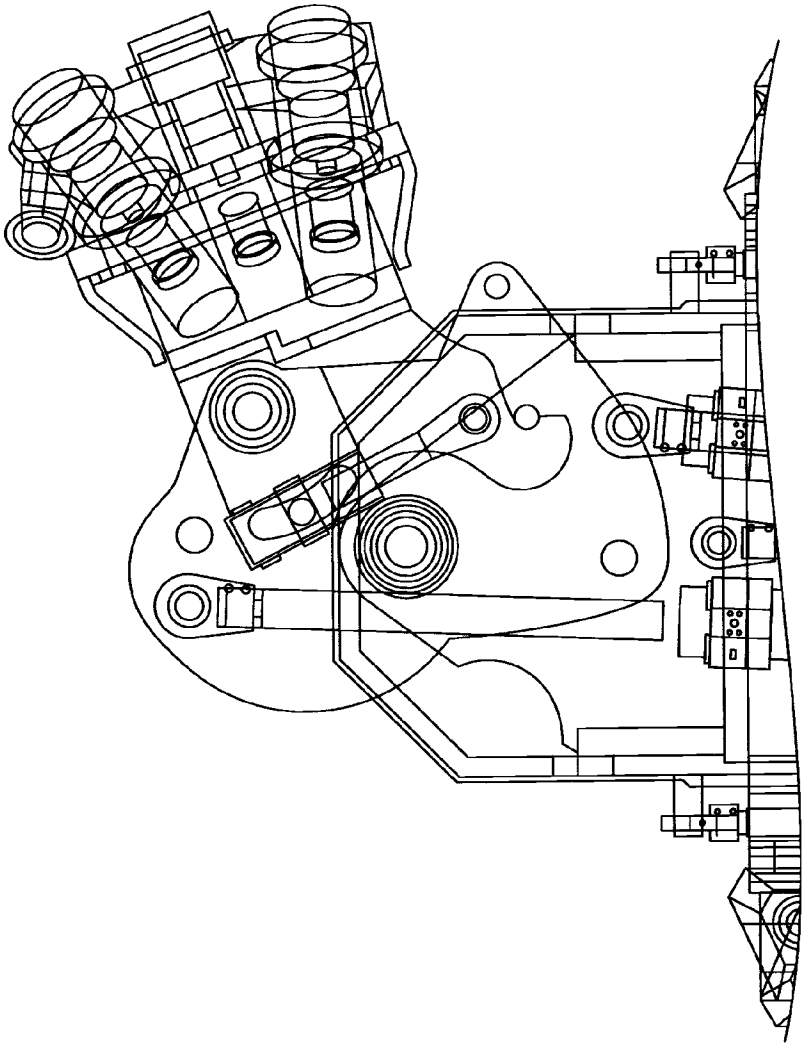
FIGS. 18 through 20 are top ghost views of the motion sequence of the arm shown in FIGS. 11 through 17.
Figure 19:
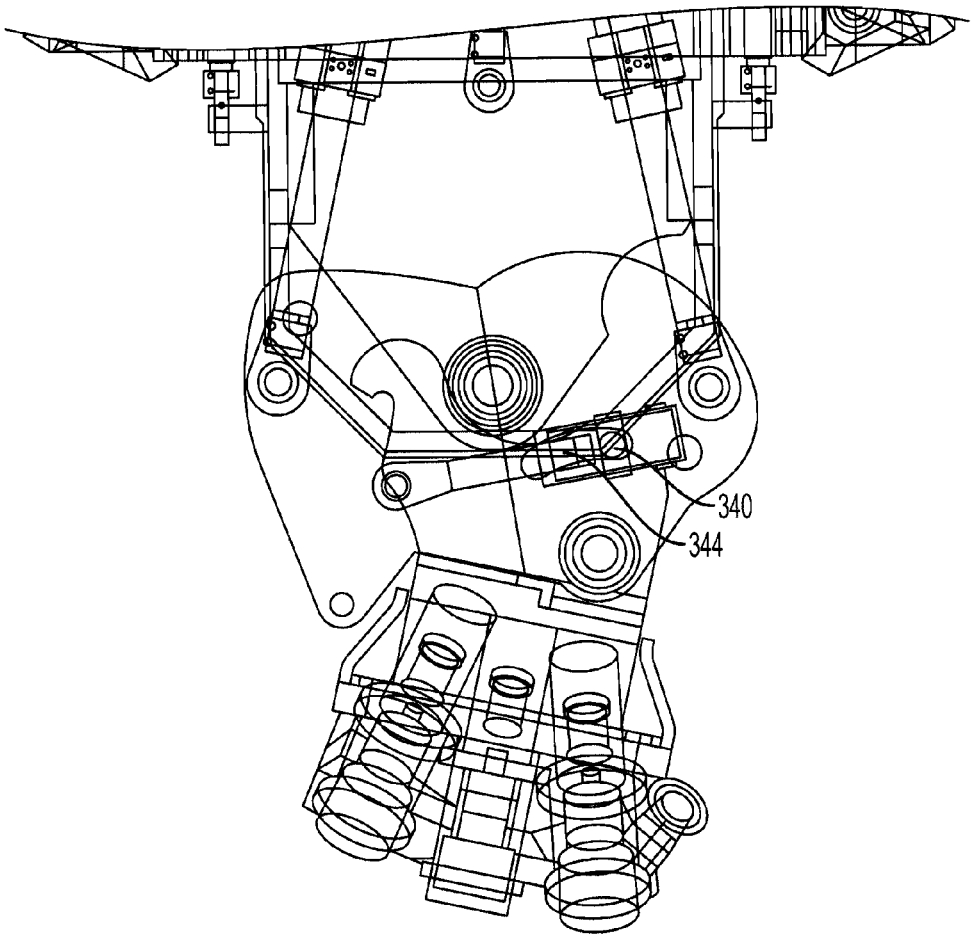
Figure 20:
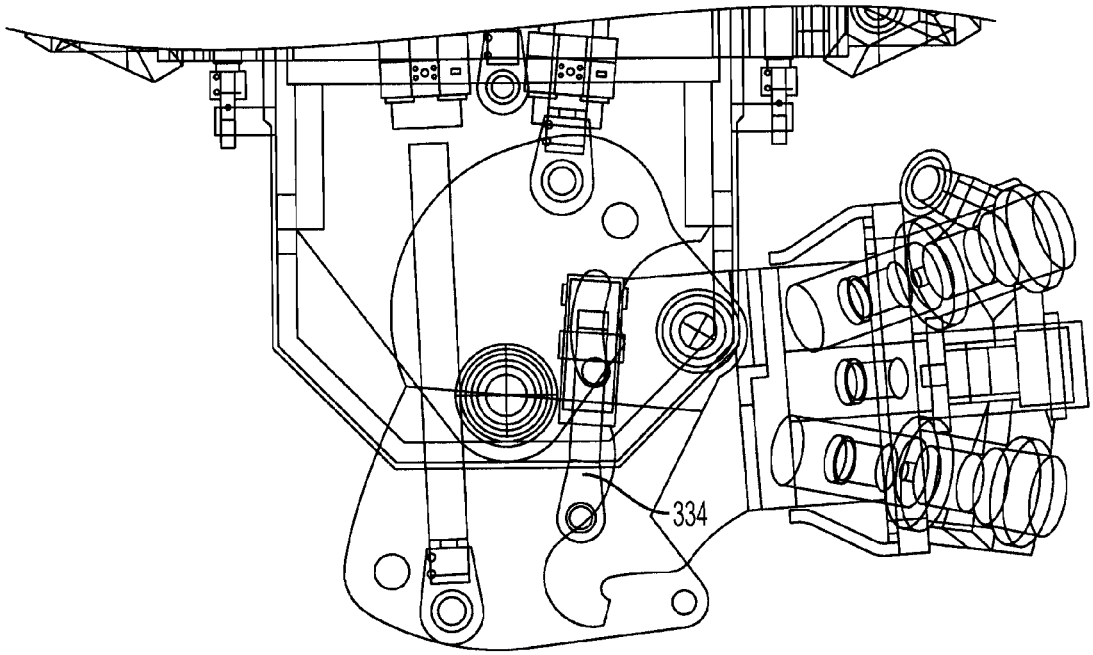

To assist in the providing of stops at the end of the wrist plates swing, mechanical stops can be used. For example, the uppermost and lower most wrist plates 326 each include a hook 352 that engages a bar 356 extending between and radially outward from the mounting plates 322 when the wrist portion 308 is fully rotated in a counter clockwise direction, when viewed from above, as shown in FIG. 15.

A cut out 360 in the uppermost main portion plate 312 removes a portion of the plate that might otherwise interfere with the support rod 330.

Various other features and advantages of the invention will be apparent from the following claims.

The invention claimed is:

1. A mining machine for liberating material from a mine wall, the mining machine comprising:

a frame;

an arm coupled to the frame and including a main portion and a wrist portion, the wrist portion including a first member that is pivotably coupled to the main portion about a first axis and a second member pivotably coupled to the first member about a second axis, the second member including a cutter head, the cutter head having at least one disc cutter for engaging the mine wall, the cutter head defining a leading edge and a trailing edge, the leading edge being adapted to engage the mine wall before the trailing edge engages the mine wall when the wrist portion is pivoted relative to the main portion;

a first actuator for pivoting the first member relative to the main portion, the first actuator including a first end coupled to the main portion and a second end directly coupled to the first member; and a second actuator for pivoting the second member relative to the first member, the second actuator including a first end coupled to the first member and a second end coupled to the second member, wherein the combined pivoting of the first member and the second member moves the leading edge through an angle greater than 180 degrees about the first axis.

2. The mining machine of claim 1, wherein the main portion includes a pair of spaced apart main plates and a support rotatably coupled to and extending between the main plates, the first member being pivotably coupled to the support, the support defining the first axis.

3. A mining machine in accordance with claim 2 wherein the first member includes two spaced apart mounting plates attached to said support, and the second member includes two spaced apart wrist plates, parallel to but spaced radially outward from the mounting plates relative to the first axis, said wrist plates being pivotally attached to the mounting plates by a wrist rod that extends between the wrist plates and through an opening in the mounting plates.

4. A mining machine in accordance with claim 3 wherein an uppermost wrist plate and a lower most wrist plate each include a hook that engages a bar extending between and radially outward from the mounting plates when the second member is fully rotated.

5. A mining machine in accordance with claim 3 wherein the first actuator includes two spaced apart hydraulic cylinders extending between the main portion and the first member so that the mounting plates rotate relative to the main portion, one cylinder being attached to one of the mounting plates on one side of the support, and the other cylinder being attached to the same mounting plate on the other side of the support, so that by extending one cylinder and retracting the other cylinder, the first member pivots relative to the main portion about the support.

6. A mining machine in accordance with claim 3 wherein the second actuator includes a hydraulic cylinder extending between the mounting plates and a wrist rod attached to and extending between the spaced apart wrist plates, the wrist rod being received in and passing through a curved slot in the mounting plates, so that the wrist plates pivot relative to the mounting plates.

7. A mining machine in accordance with claim 6 wherein a cut out in the main portion receives the wrist rod to prevent the main portion from interfering with the wrist rod during pivoting of the wrist portion.

8. A mining machine in accordance with claim 1 wherein the leading edge moves through an angle of about 220 degrees about the first axis.

9. A mining machine in accordance with claim 1 wherein the disc cutter is eccentrically driven.

10. A mining machine in accordance with claim 1 wherein the first actuator and the second actuator are hydraulic cylinders, wherein extension and retraction of the first actuator pivots the first member about the first axis and extension and retraction of the second cylinder pivots the second member about the second axis.

11. A mining machine in accordance with claim 1 wherein the cutter head includes a first disc cutter, a second disc cutter, and a third disc cutter, the first disc cutter being positioned proximate the leading edge of the cutter head, the second disc cutter being positioned proximate the trailing edge, and the third disc cutter being positioned between the first and second disc cutters.

12. A mining machine for liberating material from a mine wall, the mining machine comprising:

an arm including a main portion and a wrist portion, the wrist portion including a first member that is pivotably coupled to the main portion about a first axis and a second member pivotably coupled to the first member about a second axis, the second member including a cutter head, the cutter head having at least one disc cutter for engaging the mine wall;

a first actuator for pivoting the first member relative to the main portion, the first actuator including a first end coupled to the main portion and a second end directly coupled to the first member; and a second actuator for pivoting the second member relative to the first member, the second actuator including a first end coupled to the first member and a second end coupled to the second member, wherein the combined pivoting of the first member and the second member through a maximum range of motion moves the cutter head about the first axis between a first point and a second point, the angular distance between the first point and the second point relative to the first axis being more than 180 degrees.

13. A mining machine in accordance with claim 12 wherein the cutter head moves through an angle of about 220 degrees about the first axis.

14. A mining machine in accordance with claim 12 wherein the disc cutter is eccentrically driven.

15. A mining machine in accordance with claim 12 wherein the first actuator and the second actuator are hydraulic cylinders, wherein extension and retraction of the first actuator pivots the first member about the first axis and extension and retraction of the second cylinder pivots the second member about the second axis.

16. A mining machine in accordance with claim 12 wherein the cutter head defines a leading edge and a trailing edge, the leading edge being adapted to engage the mine wall before the trailing edge engages the mine wall when the wrist portion is pivoted relative to the main portion, the leading edge being pivotable through an angle of more than 180 degrees about the first axis.

17. A mining machine in accordance with claim 12 wherein the main portion includes a pair of spaced apart main plates and a support extending between the main plates, the support defining the first axis, and wherein the first member includes a pair of mounting plates pivotably coupled to the support.

18. A mining machine in accordance with claim 17 wherein the mounting plates include a slot, and wherein the second member includes a pair of spaced apart wrist plates parallel to the mounting plates and a wrist rod extending between the wrist plates, the wrist rod being positioned within the slot, wherein the second actuator is coupled between the first member and the wrist rod to move the wrist rod within the slot.

19. A mining machine in accordance with claim 12 wherein the arm further includes a stop engaging the wrist portion when the wrist portion is pivoted to an end of the wrist portion's range of motion.

* * * * *